US006183335B1

(12) United States Patent
Petersen

(10) Patent No.: US 6,183,335 B1
(45) Date of Patent: Feb. 6, 2001

(54) SUSPENDED DISPLAY ARRANGEMENT FOR VEHICLES

(76) Inventor: Christine Petersen, 633 Roseland Ave., Jenkintown, PA (US) 19046

( * ) Notice: Under 35 U.S.C. 154(b), the term of this patent shall be extended for 0 days.

(21) Appl. No.: 09/458,383

(22) Filed: Dec. 10, 1999

(51) Int. Cl.[7] ..... A63H 33/00
(52) U.S. Cl. ..... 446/227; 446/487
(58) Field of Search ..... 446/227, 487, 446/322, 387, 73, 80, 147, 149; 40/424, 613, 672, 119; 273/281, 282.1, 282.2; 434/81, 72, 73, 368, 429

(56) References Cited

U.S. PATENT DOCUMENTS

| | | | | |
|---|---|---|---|---|
| 187,139 | * | 2/1877 | Howard . | |
| 613,503 | * | 11/1898 | Du Bois . | |
| 1,652,971 | * | 12/1927 | Augur . | |
| 2,554,408 | * | 5/1951 | Hile . | |
| 3,085,610 | * | 4/1963 | Vardan . | |
| 3,968,573 | | 7/1976 | Poliniere | 35/7 R |
| 4,403,000 | | 9/1983 | Gates | 427/206 |
| 4,661,072 | * | 4/1987 | White | 434/260 |
| 5,167,565 | * | 12/1992 | Metcalf | 446/491 |
| 5,178,542 | * | 1/1993 | Chigrinsky et al. | 434/157 |
| 5,195,918 | * | 3/1993 | Mozes | 446/227 |
| 5,421,583 | * | 6/1995 | Gluck | 273/293 |
| 5,533,902 | * | 7/1996 | Miller | 434/112 |
| 5,634,796 | * | 6/1997 | Dollar | 434/236 |
| 5,820,383 | * | 10/1998 | Levins | 434/238 |
| 5,897,416 | * | 4/1999 | Barrows | 446/147 |

* cited by examiner

*Primary Examiner*—Jacob K. Ackun
*Assistant Examiner*—Urszula M Cegielnik
(74) *Attorney, Agent, or Firm*—Henderson & Sturm LLP

(57) ABSTRACT

A suspended display arrangement (10) used in conjunction with the seat (100) of a vehicle for amusing infants and young children. The arrangement (10) includes a generally inverted U-shaped housing member (20) having a generally opaque rear housing panel provided with a background image (24) connected by a flexible hinge element (22) to a generally transparent front housing panel (23) provided with foreground images (25), and a plurality of free swinging display units (12) disposed intermediate the front (23) and rear (21) housing panels so that the movement of a vehicle will cause the display units (12) to sway back and forth within the housing member (20).

19 Claims, 2 Drawing Sheets

SUSPENDED DISPLAY ARRANGEMENT FOR VEHICLES

BACKGROUND OF THE INVENTION

1. Field of the Invention

The present invention relates to the field of moveable decorative displays in general, and in particular to a suspended article amusement device for children riding in a vehicle.

2. Description of Related Art

As can be seen by reference to the following U.S. Pat. Nos. 3,698,573; 5,178,542; 5,533,902; 5,820,383; and 4,403,000, the prior art is replete with myriad and diverse display arrangements having selectively positionable elements.

While all of the aforementioned prior art constructions are more than adequate for the basic purpose and function for which they have been specifically designed, they are uniformly deficient with respect to their failure to provide a simple, efficient, and practical display device having a plurality of suspended articles that move in an arcuate path within the display device to amuse children during trips in a vehicle.

As anyone who has spent time traveling with infants and young children is all too well aware, their young minds require almost constant stimulation in order to prevent them from becoming cranky, irritable, or generally out of sorts.

As a consequence of the foregoing situation, there has existed a longstanding need for a new and improved type of suspended display arrangement for vehicles wherein the vehicle motion will impart a variable swinging motion to a plurality of decorative articles contained within the display arrangement, and the provision of such a construction is a stated objective of the present invention.

BRIEF SUMMARY OF THE INVENTION

Briefly stated, the display arrangement for vehicles that forms the basis of the present invention comprises in general, a housing unit adapted to be suspended from the seat of a vehicle. The housing unit contains a plurality of decorative units which are suspended within the housing unit and influenced by the motion of the vehicle.

As will be explained in greater detail further on in the specification, the housing unit comprises a generally U-shaped housing member having an opaque rear panel and a transparent front panel connected together by a flexible hinge element which is suspended from a vehicle seat by an elongated looped tether member.

In addition, the opaque rear panel is provided with a decorative background design and selected portions of the transparent front panel may be provided with foreground images to give visual depth to the scene depicted on the housing unit.

Furthermore, the plurality of decorative units comprise a plurality of decorative articles having a thematic appearance compatible to the scene depicted on the housing unit. Each of the decorative articles are releasably suspended within the housing unit from individual tether elements.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
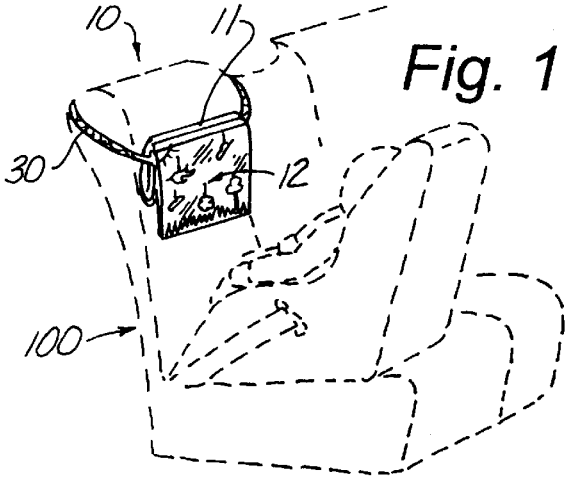
FIG. 1 is a perspective view of the display arrangement of this invention suspended from a vehicle seat.

As can be seen by reference to the drawings, and in particular to FIG. 1, the suspended display arrangement for vehicles that forms the basis of the present invention is designated generally by the reference number 10. The display arrangement 10 comprises in general, a housing unit 11, and a plurality of display units 12 suspended within the housing unit 11. These units will now be described in seriatim fashion.

Figure 3:
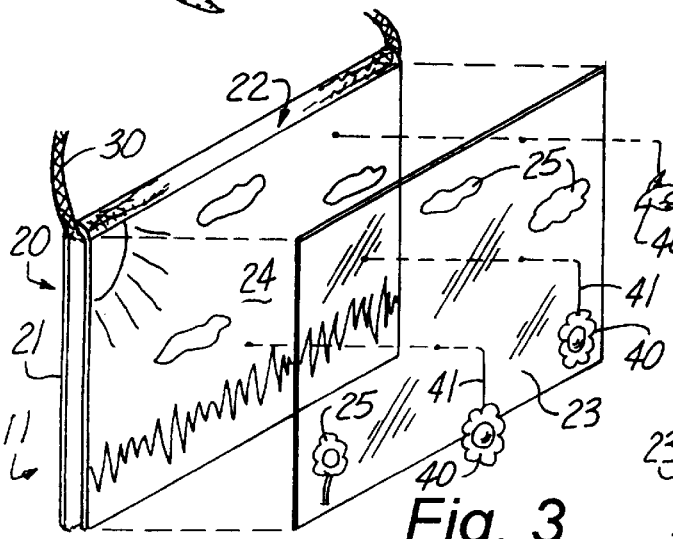
FIG. 3 is a partially exploded perspective view of a display arrangement having a floral theme.

In the first version of the preferred embodiment illustrated in FIG. 3, it can be seen that the housing unit 11 comprises a generally inverted U-shaped housing member 20 which includes a generally opaque rear housing panel 21 connected by a flexible hinge element 22 to a generally transparent front housing panel 23. The housing member 20 is suspended from a port ion of a vehicle seat 100 as shown in FIGS. 1 and 6 by a looped tether member 30 which passes beneath the flexible hinge element 22.

As can best be appreciated by reference to FIG. 3, the rear housing panel 21 is provided with a background image designated generally as 24 which occupies generally the entire visible surface of the generally opaque rear housing panel 21. Selected portions of the generally transparent front housing panel 23 are provided with foreground images designated generally as 25 to give an illusion of depth to a viewer as will be explained in detail presently.

Figure 5:
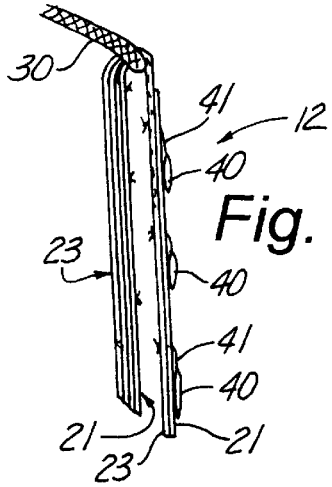
FIG. 5 is a side view of an interchangeable scene version of the display arrangement.
Figure 6:
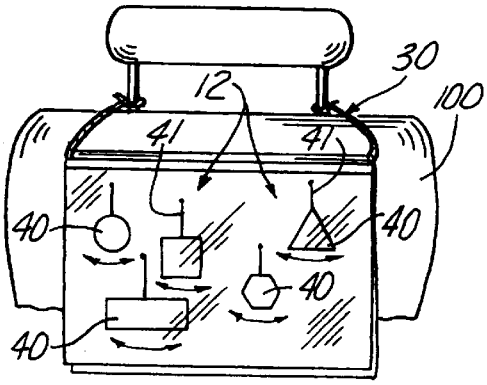
FIG. 6 is a front perspective view of the display arrangement suspended from the headrest portion of a vehicle seat.

As can best be seen by reference to FIGS. 5 and 6, the plurality of display units 12 comprise a plurality of differently configured decorative article members 40 which are suspended from individual relatively short tether elements 41 whose upper ends are adapted to be releasably secured at selected locations on the visible face of the generally opaque rear housing panel 21 by use of any suitable conventional fastening means (not shown) such as pins, clear headed tacks, etc.

Figure 2:
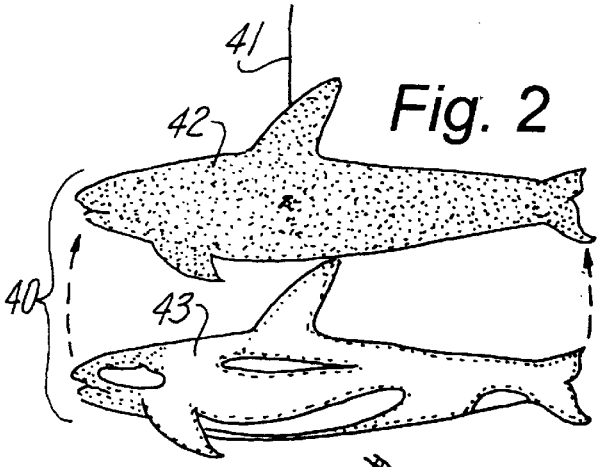
FIG. 2 is an isolated exploded perspective view showing the interchangeable aspect of one of the display units.

Turning now to FIG. 2, it can be seen that each of the decorative article members 40 may comprise a contoured main backing element 42 and a like contoured releasable interchangeable cover element 43 whereby the visual appearance of the decorative article member 40 may be altered by substitution of different cover elements 43 on a given backing element 42.

It should also be appreciated at this juncture that the releasable engagement between the backing element 42 and the cover element 43 may be accomplished by hook and loop fasteners, magnetic attraction, etc.

Figure 8:
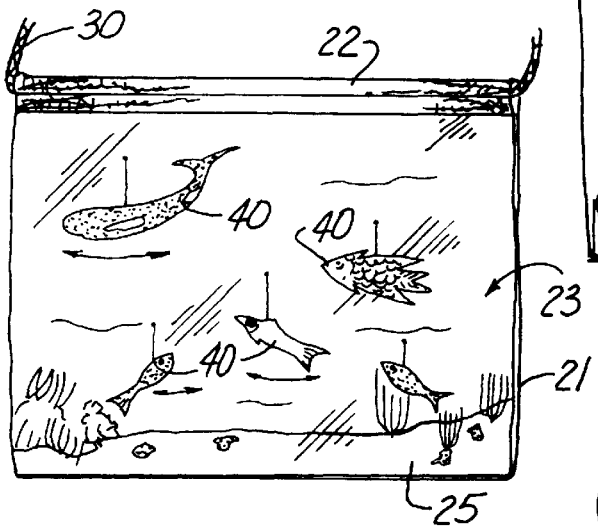
FIGS. 8 through 10 are front perspective views of various thematic displays that can be employed in this invention.
Figure 9:
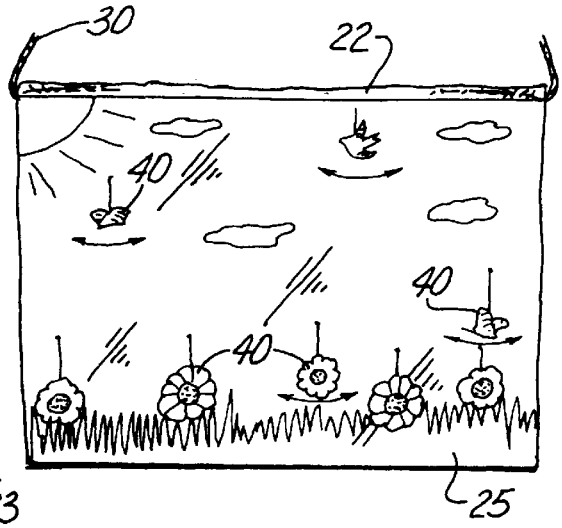
Figure 10:
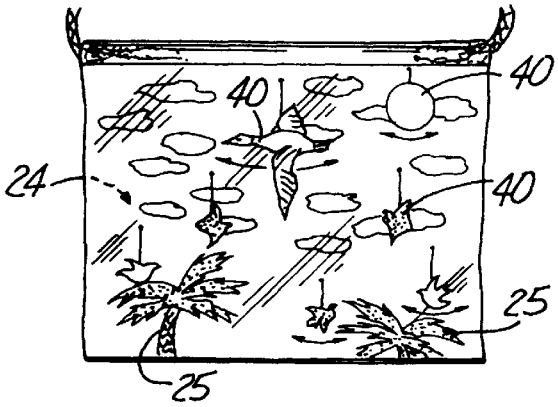

Turning now to FIGS. 8 through 10, it can be seen that the enlarged background image 24 on the opaque rear housing panel 21 and the spaced foreground images 25 on the generally transparent front housing panel 23 are chosen to represent a given theme such as aquatic, pastoral, or aerial. The decorative article members 40 in the aquatic theme of FIG. 8 resemble different types of fish, the decorative article members 40 in the pastoral theme of FIG. 9 resemble flowers and butterflies, and the decorative article members 40 in the aerial theme of FIG. 10 resemble birds, leaves, clouds, and the sun.

At this juncture, it should be appreciated that the decorative article members 40 are suspended between the front 23 and rear 21 housing panels such that the decorative article members 40 will swing freely back and forth within the housing member 20 in response to the movement of a vehicle in which the decorative arrangement is installed.

Figure 7:
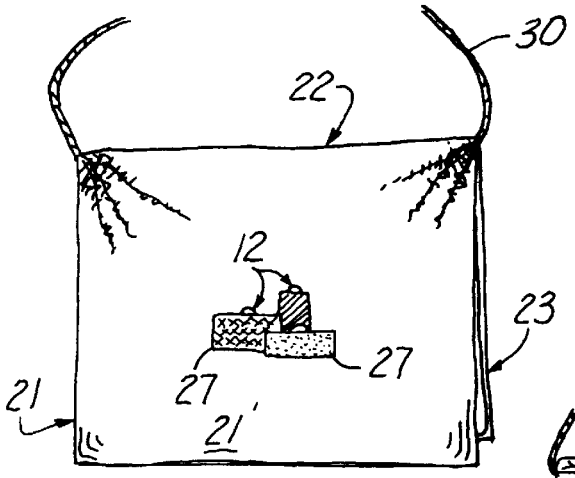
FIG. 7 is an isolated rear perspective view of the display arrangement.

In addition, as shown in FIG. 7, this invention contemplate the provision of one or more pocket elements 27 on the reverse side 21' of the rear housing panel 21. The pocket elements 27 are provided to permit storage for the plurality of display units 12 when not in use.

Figure 4:
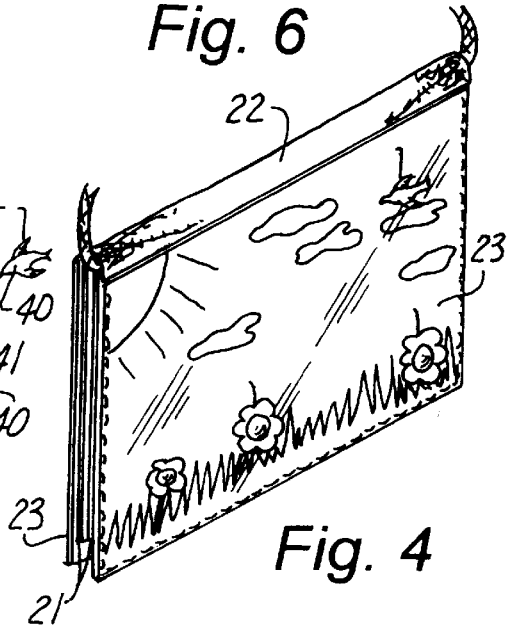
FIG. 4 is a perspective view of the display arrangement of FIG. 3.

Turning now to FIGS. 4 and 5, it can be seen that this invention also contemplates the use of a plurality of opaque 21 and generally transparent 23 housing panels connected to one another in an alternating fashion by the flexible hinge element 22 such that a plurality of different thematic scenes can be incorporated into the display arrangement to allow a parent or guardian to vary the moveable visual image that is observed by the child or infant that the arrangement 10 is intended to entertain.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A motion responsive display arrangement for infants or children riding in a vehicle wherein the display arrangement comprises:

a housing unit including a housing member having a first housing panel having a first face a plurality of display units swingingly suspended directly from the first face of the housing panel; and, means for supporting said housing member in a generally upright position within said vehicle so that the motion of the vehicle will impart a swinging motion to said plurality of display units.

2. The arrangement as in claim 1; wherein said plurality of display units are further adapted to be releasably suspended from the first face said first housing panel.

3. The arrangement as in claim 1; wherein, said first housing panel is generally opaque.

4. The arrangement as in claim 1; wherein, said first housing panel is generally transparent.

5. The arrangement as in claim 2; wherein, said first housing panel is generally opaque.

6. The arrangement as in claim 2; wherein, said first housing panel is generally transparent.

7. The arrangement as in claim 1; wherein, the housing member has a generally inverted U-shaped configuration and further includes a second housing panel connected to said first housing panel be a flexible hinge element.

8. The arrangement as in claim 7; wherein, said first housing panel is generally opaque and said second housing panel is generally transparent.

9. The arrangement as in claim 7; wherein, said first housing panel is generally transparent and said second housing panel is generally opaque.

10. The arrangement as in claim 8; wherein, said first housing panel is provided with a background image and the plurality of display units are provided with an appearance that is thematically compatible with said background image.

11. The arrangement as in claim 10; wherein, said second housing panel is provided with a foreground image that is compatible with said background image.

12. The arrangement as in claim 10; wherein, said second housing panel is provided with a foreground image and the plurality of display units are provided with an appearance that is thematically compatible with said foreground image.

13. The arrangement as in claim 12; wherein, said first housing panel is provided with a background image that is thematically compatible with said foreground image.

14. The arrangement as in claim 3; wherein, said first housing panel is provided with a background image and the plurality of display units are provided with an appearance that is compatible with said background image.

15. The arrangement as in claim 4; wherein, said first housing panel is provided with a foreground image and the plurality of display units are provided with an appearance that is compatible with said foreground image.

16. The arrangement as in claim 1; wherein, the plurality of display units comprise a plurality of decorative article numbers.

17. The arrangement as in claim 7; wherein, the housing member includes at least a pair of first and second panel members attached to said flexible hinge element and arranged in an alternating sequential fashion.

18. The arrangement as in claim 17; wherein, the first panel members are generally transparent and the second panel members are generally opaque.

19. The arrangement as in claim 17; wherein, the first panel members are generally opaque and the second panel members are generally transparent.

* * * * *